United States Patent [19]

Dislich et al.

[11] Patent Number: 4,525,463

[45] Date of Patent: Jun. 25, 1985

[54] SPOUT-FILLING MASS

[75] Inventors: Heinz Dislich, Am Botanischen Garten 8, D-4100 Duisburg 1; Horst Richter, Duisburg, both of Fed. Rep. of Germany

[73] Assignees: Heinz Dislich, Duisberg; Krupp Stahl Aktiengesellschaft, Bochum, both of Fed. Rep. of Germany; part interest to each

[21] Appl. No.: 438,807

[22] Filed: Nov. 3, 1982

[30] Foreign Application Priority Data

Apr. 17, 1982 [DE] Fed. Rep. of Germany ..... 3214168

[51] Int. Cl.[3] ..... B22D 41/10

[52] U.S. Cl. ..... 501/99; 222/600; 266/271

[58] Field of Search ..... 266/236, 284, 44, 272, 266/45, 271, 280, 273, 287, 275; 222/601, 600, 222/597, 591, 590, 563; 106/288 B, 302, 56, 59; 501/99, 264/30

[56] References Cited

U.S. PATENT DOCUMENTS 3,511,261 5/1970 Bick et al. ..... 222/600
3,944,116 3/1976 Danieli ..... 266/45

FOREIGN PATENT DOCUMENTS 1458180 4/1974 Fed. Rep. of Germany .
1581058 12/1980 United Kingdom ..... 222/600
1589614 5/1981 United Kingdom ..... 222/600

OTHER PUBLICATIONS

Derwent Publication No. 81696 D/45, KAOL, (6/24/81).

*Primary Examiner*—M. J. Andrews
*Assistant Examiner*—S. Kastler
*Attorney, Agent, or Firm*—Karl F. Ross; Herbert Dubno

[57] ABSTRACT

A spout-filling mass which is retained in place by a slider in the pouring spout of a metal-casting ladle consists essentially of 35 to 65% by weight chromite, (chromium ore with 42 to 45% $Cr_2O_3$), 3 to 25% by weight carbon and the balance quartz sand. The mass, which fills the cylindrical portion of the spout, is formed into a pile on the floor of the ladle above the spout and upon contact with the molten metal fuses into a thin shell which, upon movement of the slider to bring its opening into registry with the spout, is ruptured by the molten metal after the underlying support for the shell is discharged through the spout.

2 Claims, 2 Drawing Figures

SPOUT-FILLING MASS

FIELD OF THE INVENTION

Our present invention relates to metal-casting ladles and, more particularly, to improvements in pouring-spout arrangements for such ladles. Specifically the invention is directed to an improved filling mass for the pouring spout or nozzle of a metal-casting ladle and to a method of operating the spout and slider system of the ladle.

BACKGROUND OF THE INVENTION

Metal-casting or metal-pouring ladles or like vessels of the bottom-discharge type may be provided with a pouring spout in the form of a passage extending through the ladle lining and shell of the ladle and closed therebelow by a linearly or rotatably shiftable slider having an opening which can be aligned with or brought into registry with this passage.

To seal the spout against the high temperature molten metal when the opening in the slider is offset from the passage, i.e. in the closed position of the spout valve or closure, the passage can be filled by a so-called filling mass of pulverulent or other comminuted form. This mass is supported within the passage by the slider and is piled above the top of the passage to form a heap which extends outwardly beyond the passage and is adapted to contact the molten metal when the latter is poured into the ladle.

Upon alignment of the slider opening with the passage, this mass can be discharged and the passage cleared.

Such spout-filling masses can be used for the discharge passages, nozzles or outlets of ladles used for the handling or treatment of various metals, e.g. commercial steels and even specialty steels such as stainless steel, as well as for other metals.

While filling masses of the aforedescribed type have proved to be effective in protecting the slider, certain problems are encountered when they are used. For example, the opening operation with conventional filling masses is not reliable, i.e. a fixed flow cross section and rate of opening frequently cannot be guaranteed because such masses tend to sinter or fuse in a more or less uncontrolled manner so that obstructions remain when the slider opening is brought into registry with the passage. Frequently the entire mass fuses into a rigid and nonflowable structure so that it must be broken out with a time-consuming and hence expensive series of operations. In other cases, the passage may remain partly obstructed which is disadvantageous with respect to the pouring operation and subsequent treatment of the melt.

In general, therefore, the use of earlier filling masses has been found to be fraught with problems which have been associated with high casting costs, unreliable performance and dangerous conditions such that the casting operation as a whole can be adversely affected.

Conventional filling masses include quartz sand, chromite zirconia, magnesite, iron oxide, titanium dioxide or mixtures thereof.

It should also be noted that conventional masses can effectively be used only under very limited sets of operating conditions empirically determined for each mass. In other words, any particular mass does not have general applicability.

Reference may be had to German Printed Application DE-AS 14 58 180 which describes a spout-filling mass consisting exclusively of quartz and anthracite coal (column 3, lines 8 through 10).

Experience with this system has shown that opening of the spout cannot be guaranteed, i.e. the movement of the closure plate to align its opening with that of the spout for exchange of melt poses a problem.

In some cases, flow does not automatically commence so that considerable manipulation is necessary to start the discharge.

Furthermore, for any effective use of this system it is necessary to provide a special geometry of the spout which also is an expensive proposition.

OBJECTS OF THE INVENTION

It is the principal object of the present invention to provide an improved filling mass for the purposes described which has general applicability and is practically 100% percent reliable, independently of the ladle parameters, in providing a total opening of the discharge passage of the ladle and a rapid opening thereof.

Another object of the invention is to provide a highly reliable method of operating the discharge spout of a metal-pouring ladle.

Still another object of this invention is to provide a spout-filling mass which assures revival opening of the spout of a casting ladle without manipulation or expensive spout geometries and hence to provide a system which avoids the disadvantage of prior art arrangements.

SUMMARY OF THE INVENTION

These objects and others which will become apparent hereinafter are attained, in accordance with the present invention, with a filling mass for a ladle spout as previously described which comprises 3 to 65% by weight of a chromium oxide ore, especially chromite, 3 to 25% by weight carbon and the balance quartz sand.

Apparently, the chromium ore component at the interface between the mass and the molten metal, is partly reduced by carbon and sinters or otherwise reacts with the quartz sand to form an extremely thin but uniform-thickness shell which constitutes a cap supported by the underlying particulate mass and protecting this mass against fusion or like bonding action, thereby ensuring that the remainder of this mass remains flowable. The cap or shell is practically impenetrable to the molten metal but nevertheless is sufficiently weak so that, upon discharge of the supporting material it can collapse and allow unimpeded discharge of the melt through the spout.

The cap or shell should be sufficiently stable that it is capable of supporting the molten metal even for long periods but has comparatively low thermal conductivity so that, even with overheated melts for such long periods, the cap prevents the fusion of the entire particulate mass into a solid body preventing unblocking of the spout.

While these conditions generally are fulfilled when the chromium oxide ore is present in an amount between 35 and 65% by weight of the mass and carbon, in an amount of 3 to 25% by weight of the mass so that between about 10 to 40% by weight of the mass is constituted by the quartz sand, various melt conditions retention times and chromium ore compositions will give rise to certain preferred compositions of the mass.

For example, it is preferred to use chromium ore which contains 42 to 45% weight $Cr_2O_3$. Thus, in a system which consists of about 65% by weight of such chromium ore, 25% by weight of quartz sand and 10% by weight of a carbon carrier, of the combination of $Cr_2O_3$, quartz sand and carbon, 44 to 46% by weight will represent the $Cr_2O_3$, 39 to 40% by weight will represent the quartz sand and 15 to 16% by weight will represent the elemental carbon.

In practice it has been found desirable to use technical grade carbon in an amount of 3 to 10% and 45 to 65% of such chromium ore, the balance being quartz sand, in the mass.

Preferably, the particle size of the chromite and of the quartz sand ranges up to 1 mm while the particle size of the carbon is up to 4 mm. Highly effective results are obtained with a mixture of about 57% by weight chromite particles, 6% by weight carbon particles and 37% by weight quartz sand particles although excellent results are had with 50% by weight chromite, 6 to 20% by weight carbon and about 30 to 44% by weight quartz sand.

The carbon can be electrode carbon, electrode coke or low-gassing coals such as anthracite coal or coking coals.

One of the surprising advantages of the mass described is that of aforementioned shell protects the balance of the mass against fusion even when the molten metal to be cast is overheated and remains for long periods in the ladle.

BRIEF DESCRIPTION OF THE DRAWING

The above and other objects, features and advantages of the present invention will become more readily apparent from the following description, reference being made to the accompanying drawing in which.

SPECIFIC DESCRIPTION AND EXAMPLE

Figure 1:
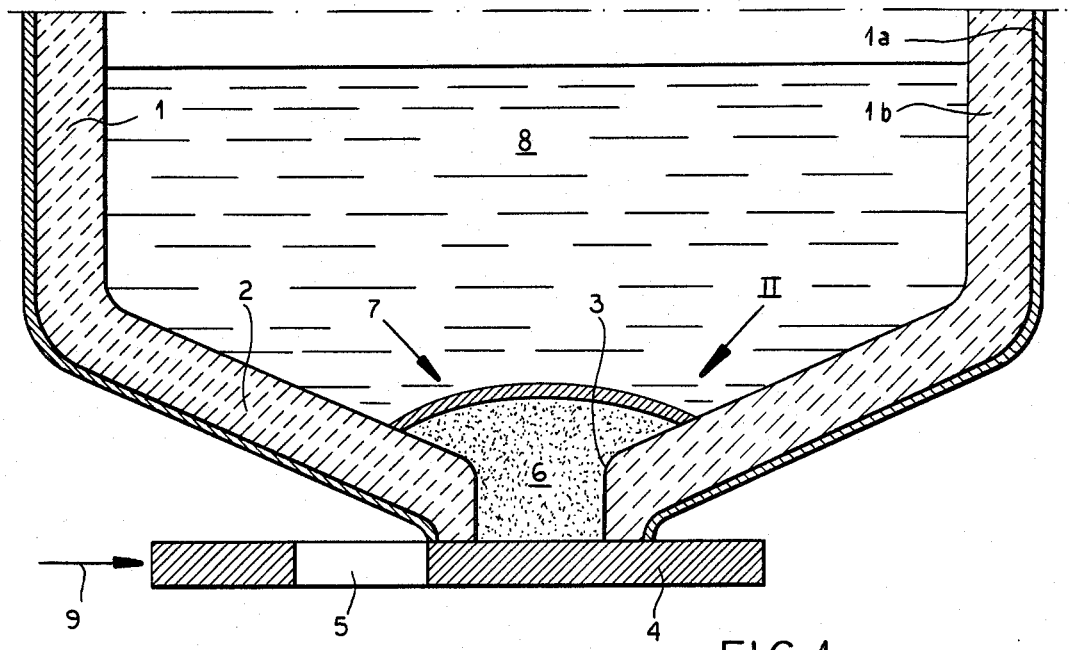
FIG. 1 is a diagrammatic section through the lower portion of a casting ladle embodying the invention.
Figure 2:
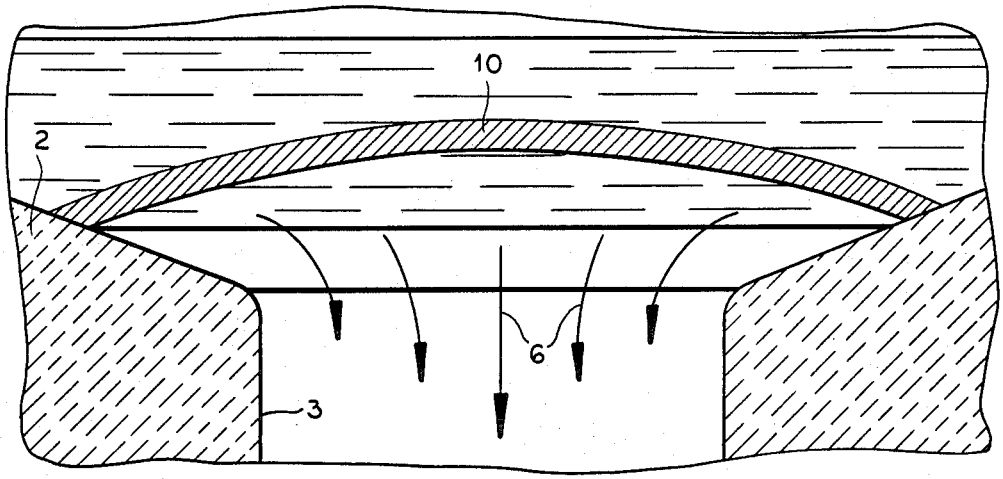
FIG. 2 is a detail view of the region II of FIG. 1.

The casting ladle 1 shown in FIG. 1 comprises, in the usual manner, an outer steel vessel 1*a* and an inner lining 1*b* of a refractory material and defining, along the downwardly sloping ladle bottom 2, a discharge spout, passage or sleeve 3.

Below this discharge spout 3 there is provided a linearly or rotatably shiftable slider 4 having an opening 5 which can be aligned with the passage 3 upon movement of the slider in the direction of the arrow 9.

With the slider in the closed position, the filling mass 6 is poured into the spout 3 so that it rests upon the slider 4 and forms a heap above the spout 3 overhanging the sides of the bottom 2 around the spout (see FIG. 1).

The result is a heap 7 which comes into contact with the molten metal 8 which is introduced into the ladle in a stream impinging on the bottom 2 adjacent the heap.

As previously noted, a thin shell 10 forms by the reductive reaction of the carbon with the chromite and sand and is supported by the remainder of the mass 6 upon the plate 4 until the plate is shifted to align the opening 5 with the passage 3 and discharge the free-flowing particles. Under the hydrostatic pressure, the now unsupported cap or shell 10 is displaced out of the opening as well.

The mass 6 comprises a mixture of 35 to 55% by weight chromite, 15 to 25% by weight carbon and the balance quartz sand.

The chromite proportion is selected to ensure that it will react with the carbon content at the interface between the heap 7 and the melt to form the cap or shell 10.

SPECIFIC EXAMPLE

The mass can be formed from the following components (for 1000 kg of the filling mass).

| | |
|---|---|
| 650 kg | Chromium ore |
| +250 kg | Quartz sand |
| +100 kg | Electrode coal |
| ~1000 kg | Mass |
| Chromium Ore: | ~42–45% $Cr_2O_3$ |
| Particle Size: | 0–1 mm/Ø0.35 mm |
| Fraction: | <0.1 mm~1.5% |
| | 0.1 mm~15.0% |
| | 0.2 mm~25.0% |
| | 0.3 mm~43.0% |
| | >0.5 mm~15.0% |
| Quartz Sand (silver sand) dried | |
| Particle size: | 0.1–1.0 mm |
| Fraction: | >1.0~0% |
| | 0.5~0.1% |
| | 0.3~13.3% |
| | 0.2~55.0% |
| | 0.1~31.5% |
| | <0.1~0.1% |
| Low-gassing coal~90% C. | |
| Particle size: | 0–4 mm |
| Fraction: | ≦0.1 mm 10.0% |
| | 0.1–0.5 mm 40.0% |
| | ≧0.5–2.0 mm 40.0% |
| | >3.0 mm~10.0% |

All components are as free from moisture as possible and are flowable.

We claim:

1. A particulate filling mass for filling the pouring spout of a casting ladle which consists of essentially 10% by weight carbon, 25% by weight quartz sand and the balance a chromite chromium ore containing 44 to 46% by weight $Cr_2O_3$, the chromium ore and the quartz sand having particle sizes up to 1 mm, the carbon having a particle size up to 4 mm.

2. The mass defined in claim 1 wherein said carbon is selected from the group which consists of electrode carbon, electrode coke, coking coal and low-gassing coals and mixtures thereof.

* * * * *